US008515570B2

(12) United States Patent
Lee

(10) Patent No.: US 8,515,570 B2
(45) Date of Patent: Aug. 20, 2013

(54) SYSTEM FOR SENSING CIGARETTE FILTERS AND METHOD THEREFOR

(75) Inventor: Jong Myung Lee, Sacheon (KR)

(73) Assignee: British American Tobacco Korea Limited, Seoul (KR)

( * ) Notice: Subject to any disclaimer, the term of this patent is extended or adjusted under 35 U.S.C. 154(b) by 939 days.

(21) Appl. No.: 12/065,887

(22) PCT Filed: Aug. 24, 2006

(86) PCT No.: PCT/GB2006/003213

§ 371 (c)(1),
(2), (4) Date: Jun. 26, 2008

(87) PCT Pub. No.: WO2007/028957

PCT Pub. Date: Mar. 15, 2007

(65) Prior Publication Data

US 2008/0314397 A1 Dec. 25, 2008

(30) Foreign Application Priority Data

Sep. 6, 2005 (KR) ..... 10-2005-0082716

(51) Int. Cl.

| | |
|---|---|
| ***A24C 5/33*** | (2006.01) |
| ***B31B 1/00*** | (2006.01) |
| ***B31C 99/00*** | (2009.01) |
| ***G01V 8/00*** | (2006.01) |
| ***G06F 19/00*** | (2011.01) |

(52) U.S. Cl.

USPC ..... 700/110; 700/95; 700/109; 131/282; 250/559.04; 250/559.39; 250/559.4; 493/4; 493/14; 493/16; 493/22; 493/40; 493/45

(58) Field of Classification Search

USPC ..... 700/95, 109, 110; 131/28, 29, 111, 131/282, 907, 910; 250/559.04, 559.39, 250/559.4; 493/4, 12–14, 16, 22, 39, 40, 493/45, 47

See application file for complete search history.

(56) References Cited

U.S. PATENT DOCUMENTS

RE25,917 E * 11/1965 Stelzer ..... 493/47
4,011,457 A * 3/1977 Wolf ..... 250/559.39

(Continued)

FOREIGN PATENT DOCUMENTS

| | | |
|---|---|---|
| DE | 3030140 | 3/1982 |
| EP | 1557100 | 7/2005 |
| FR | 2395487 | 1/1979 |

OTHER PUBLICATIONS

International Search Report and Written Opinion dated Nov. 30, 2011, corresponding to PCT/GB2006/003213.

(Continued)

*Primary Examiner* — Mohammad Ali
*Assistant Examiner* — Jennifer L Norton
(74) *Attorney, Agent, or Firm* — N W Poulsen

(57) ABSTRACT

The invention provides a system for sensing a cigarette filter, comprising: a plurality of rotary conveyance drums (12) delivering a first cigarette filter and second cigarette filters into which the first cigarette filter is divided by a cutter; two sensors (18) disposed adjacent to the rotary conveyance drum (12) to detect the second cigarette filters; an opto coupler connected to the two sensors (18) and operated by AND logic; a HIP connected to the opto coupler, it controlling a device of supplying cigarette filters to reject a cigarette having defects; and, a PLC connected with the HIP, it controlling the device of supplying cigarette filters, wherein the two sensors (18) detect active charcoal filters located at both ends of the second cigarette filters, the HIP controls the device such that the cigarette having defects are rejected when signals sensed by the sensors (18) are different from signals sensed from the normal active charcoal filter, the PLC controls the operation and stop of the device by performing the processes except the process of rejecting the cigarette having defects.

12 Claims, 7 Drawing Sheets

(56) References Cited

U.S. PATENT DOCUMENTS

| | | | | |
|---|---|---|---|---|
| 4,011,950 | A * | 3/1977 | McLoughlin et al. | 209/536 |
| 4,043,454 | A * | 8/1977 | Reuland | 209/571 |
| 4,212,541 | A * | 7/1980 | Ducommun et al. | 356/430 |
| 4,238,994 | A * | 12/1980 | Koch | 493/4 |
| 5,583,633 | A * | 12/1996 | Matsumura et al. | 356/237.2 |
| 6,264,591 | B1 * | 7/2001 | Keen et al. | 493/4 |
| 6,384,359 | B1 | 5/2002 | Belcastro | |
| 6,385,333 | B1 * | 5/2002 | Puckett et al. | 382/143 |
| 8,360,947 | B2 * | 1/2013 | Eusepi et al. | 493/39 |
| 2005/0054501 | A1 | 3/2005 | Schroder | |
| 2005/0098744 | A1 * | 5/2005 | Schroder et al. | 250/559.19 |
| 2012/0010059 | A1 * | 1/2012 | Righetti et al. | 493/4 |
| 2012/0077659 | A1 * | 3/2012 | Yanchev et al. | 493/39 |
| 2012/0302416 | A1 * | 11/2012 | Barnes et al. | 493/39 |

OTHER PUBLICATIONS

International Preliminary Report on Patentability dated Oct. 24, 2007 corresponding to PCT/GB2006/003213.

* cited by examiner

SYSTEM FOR SENSING CIGARETTE FILTERS AND METHOD THEREFOR

CLAIM FOR PRIORITY

This application is a National Stage Entry entitled to and hereby claims priority under 35 U.S.C. §§365 and 371 from PCT Application No. PCT/GB2006/003213, titled, "SYSTEM FOR SENSING CIGARETTE FILTERS AND METHOD THEREFOR," filed Aug. 24, 2006, which in turn claims priority to KR Application No. 82716/2005 filed Sep. 6, 2005 all of which is hereby incorporated by reference.

BACKGROUND OF THE INVENTION

The present invention relates to a system for sensing cigarette filters, and in particular, relates to a device that detects the existence and defects of an active charcoal filter, and thus the defects of a tow filter.

In general, a cigarette filter comprises an activated charcoal filter portion and a tow filter portion. FIG. 7 illustrates a completed cigarette filter. A common cigarette filter of this type is an active acetate dual filter 6 consisting of an active charcoal filter portion 2 and a tow filter portion 4. The charcoal filter portion 2 is connected to a tobacco rod 30 (see FIG. 2) to form a smoking article such as a cigarette 31, 32, and the tow filter portion 4 faces the mouth end of the cigarette. The active charcoal filter portion 2 is wrapped with a plug wrap 7, and then combined with the tow filter portion 4 by wrapping with an inner paper 8, and the filter 6 is then combined with a tobacco rod by a tipping paper 9 to form a cigarette 30.

FIG. 2 shows the procedure of supplying cigarette filters during the manufacture of cigarettes. As shown at the top of the Figure, a primary cigarette filter unit 20 is supplied. The primary cigarette filter unit 20 comprises four dual cigarette filters connected, i.e., in sequence from left to right as seen in the FIG. 2, there is an active charcoal filter portion 2, a tow filter portion 4, a tow filter portion 4, an active charcoal filter portion 2, an active charcoal filter portion 2, a tow filter portion 4, a tow filter portion 4, and an active charcoal filter portion 2. The primary filter unit 20 is divided by a cutter 16 (see FIGS. 1 and 3) into two secondary filter units 22, 24. The secondary filter units each consist of an active charcoal filter portion 2, a tow filter portion 4, a tow filter portion 4, and an active charcoal filter 2, and are supplied downward (as viewed in FIG. 2) by a conveying device such as a plurality of rotary conveyance drums 12. Each secondary filter unit 22, 24 has an active carbon filter portion 2 at each end. Tobacco rods 30 are attached to both ends of the secondary cigarette filter units 22, 24 by an assembly unit, and then the centre of the tow filter portion 4 located in the secondary filter unit 22, 24 is cut, whereby the finished products 31, 32 of two cigarettes each having a dual filter are produced.

However, during the process of supplying the cigarette filter units, if a jam occurs at a filtermat or a hooper that temporarily stores the filter units, the filter units may be broken or omitted. In fact, filters having defects can be generated during manufacture. In particular, the active carbon filter portions at the ends of the filter units may be broken off, damaged or omitted.

FIGS. 5 and 6 show examples of this. As shown in FIG. 5, during the supply of the filter units, if the charcoal filter portion 2 is broken at one end of the primary cigarette filter unit 20 and then the primary filter unit 20 is moved longitudinally, the cutter 16 cuts at a portion that is away from the centre of the filter unit 20. One of the secondary filter units 22 thus has the length shorter than the other filter unit 24 (the difference in the length is denoted by "A" in FIG. 5). Also, as shown in FIG. 5, the other secondary filter unit 24 has only charcoal filter at the left end and only tow filter at the right end. The final cigarette products 31, 32 are produced by cutting the filter units at the dotted lines. In this example only one non-defective cigarette is produced. Three cigarettes having defective filters are produced, indicated by shading of the tobacco rods 30.

FIG. 6 represent an example in which the charcoal filter portion 2 at the right end is missing from the primary filter unit 20 and hence also from one of the secondary filter units 24 (indicated as "B"). Therefore, one cigarette is produced wherein the charcoal filter portion does not exist, as shown by shading of the tobacco rod 30.

Also, if the charcoal filter portion 2 is broken and shortened, the position of the primary cigarette filter unit 20 may be moved, and it could happen that the length of the charcoal filter portion 2 or the tow filter 4 is changed.

If it happens that the charcoal filter portion is missing in the cigarette filter unit, or the cigarette filter unit is filled with only charcoal filter or only tow filter, or the length of the charcoal filter is changed, the taste of the cigarette varies and the filter does not function properly. Also, it could happen that the charcoal filter is located to be in contact with then mouth of the smoker.

Moreover, since these problems happen inside the cigarette, they cannot be visually seen well from the outside, and they are often undetected. The defects of the filter will damage the reliance of the customer on the products.

Techniques for sensing filters are known, but they have the disadvantage that they cannot detect all the products having defects because they sense only the outside of the filter. Also, known sensing devices have a complex construction.

SUMMARY OF THE INVENTION

Accordingly, it is an object of the invention to address the above problems.

The invention aims to detect when a tow filter portion or an active charcoal filter portion is missing, or when filter portion is dented or wrinkled, or when the filter is dirty or contaminated outside.

The invention also aims to reduce an impaired taste of the cigarette, to give reassurance to the customer.

The invention proposes to remove defective filters by use of a simple sensor.

Accordingly, a first aspect of the present invention is directed to a system for detecting defects in filters for smoking articles, comprising: a conveying device for conveying filter units, each filter unit having an active charcoal filter portion at each end; a sensing unit past which the filter units are conveyed, operable to detect the two active charcoal filter portions and produce signals representative of a present and non-defective active charcoal filter portion and of an absent or defective charcoal filter portion; and a controller operable to receive and process signals from the sensing unit and to modify operation of the conveying device in the event that the signals indicate one or both active charcoal filter portions as being absent or defective.

The system may further comprise a delivery device for delivering primary filter units; and a cutter arranged to cut the primary filter units into the said filter units before the said filter units are conveyed past the sensing unit.

The sensing unit may comprise two sensors arranged with respect to the conveying device such that each sensing unit detects one of the active charcoal filter portions in a filter unit, each sensor producing a signal representative of the associated active charcoal filter portion.

The signals may be processed using AND logic such that both signals being representative of a present and non-defective active charcoal filter portion does not cause the controller to modify operation of the conveying device.

The controller may be operable to stop the conveying device in the event that the signals indicate one or both active charcoal filter portions in a filter unit as being absent or defective. Alternatively, the controller is operable to stop the conveying device in the event that the signals indicate one or both active charcoal filter portions as being absent or defective in a predetermined number of filter units.

The system may further comprise a rejection device controlled by the controller and operable to remove a filter unit from the conveying device in the event that the signals indicate one or both active charcoal filter portions in the filter unit as being absent or defective.

The system may further comprise an assembly unit to which filter units with both active charcoal filter portions present and non-defective are conveyed after the filter units have been conveyed past the sensing unit, the assembly unit operable to combine the filter units with tobacco rods to produce smoking articles.

A second aspect of the invention is directed to a method of detecting defects in filters for smoking articles, comprising: conveying filter units each having an active charcoal filter portion at each end past a sensing unit to detect the two active charcoal filter portions and to produce signals from the sensing unit representative of a present and non-defective active charcoal filter portion and of an absent or defective charcoal filter portion; processing the signals from the sensing unit to determine whether a filter unit has one or both active charcoal filter portions absent or defective; and modifying the conveying of the filter units in the event that the signals indicate one or both active charcoal filter portions as being absent or defective.

BRIEF DESCRIPTION OF THE DRAWINGS

For a better understanding of the invention and to show how the same may be carried into effect reference is now made by way of example to the accompanying drawings in which.

DETAILED DESCRIPTION

For a better understanding of the invention, together with other objects, advantages and capabilities thereof, reference is made to the following disclosure and appended claims taken in conjunction with the above-described drawings.

Figure 1:
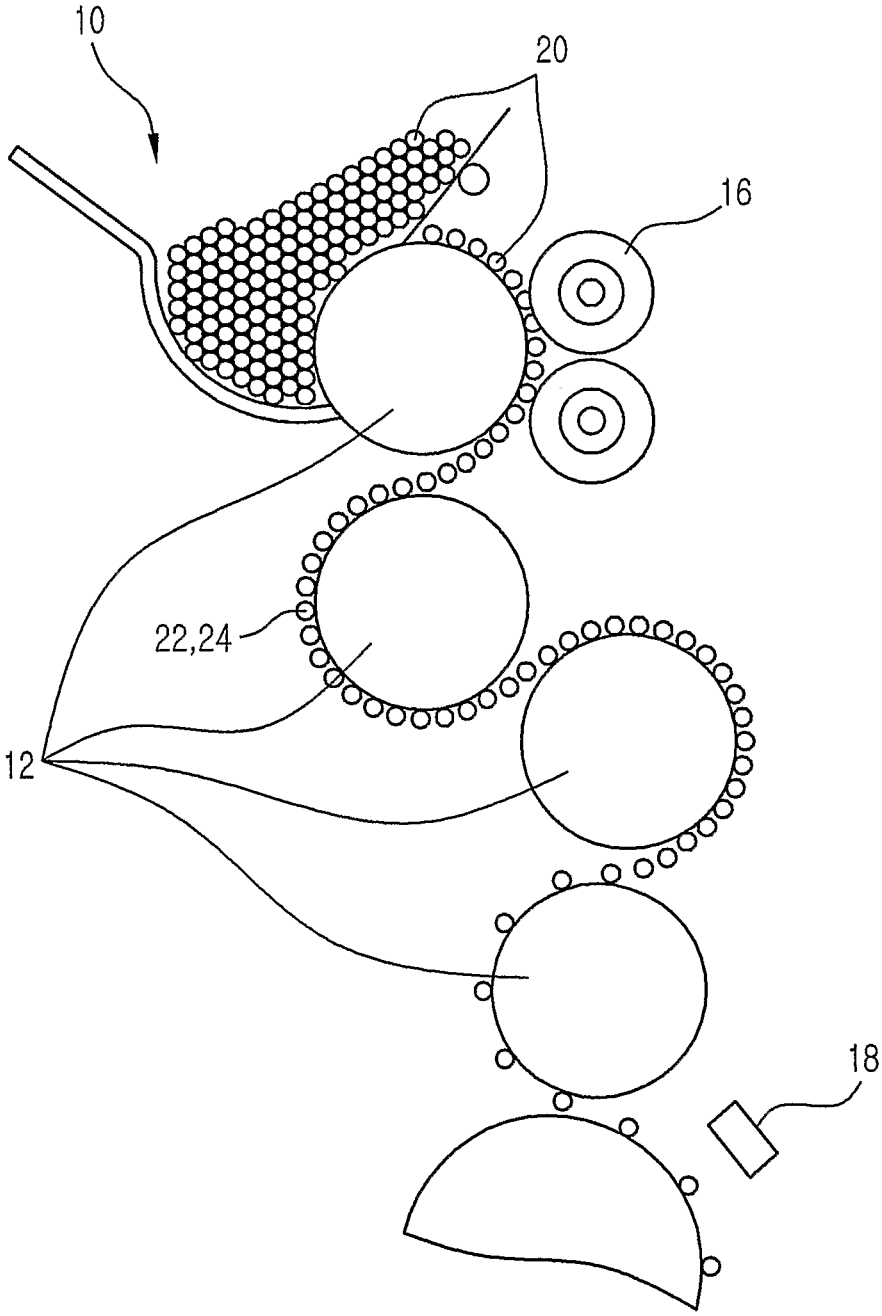
FIG. 1 shows a schematic representation of rotary conveyance drums for transporting cigarette filter units and a sensor for sensing cigarette filter units according to an embodiment of the invention.
Figure 2:
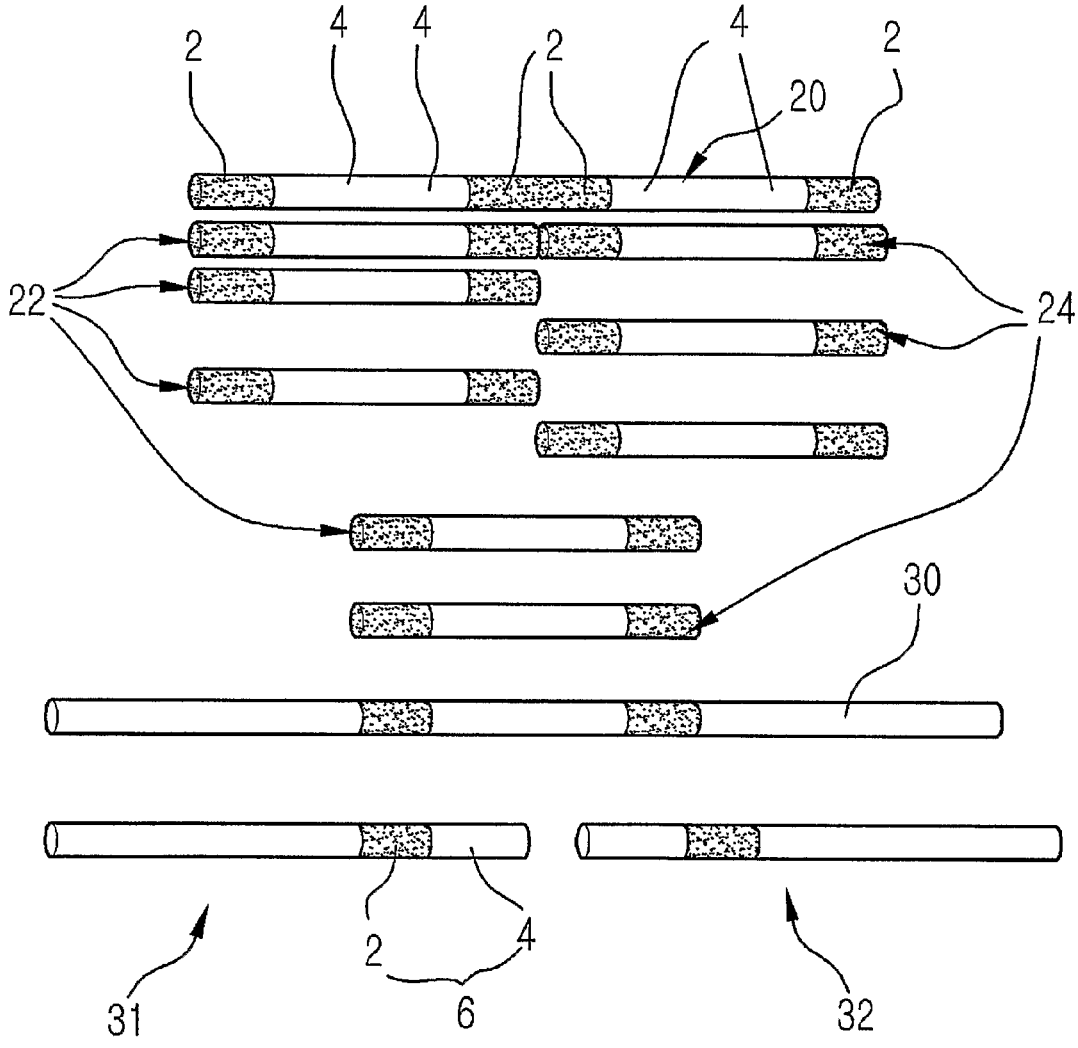
FIG. 2 shows a schematic representation of a process in which cigarette filter units are cut by a cutter and then are transported and assembled into cigarettes.

FIG. 1 shows apparatus in the process of supplying, conveying and sensing cigarette filter units. The primary cigarette filter units 20 having four dual filters connected are supplied downward (with respect to the arrangement in the Figure). The cigarette filter units 20 are moved downward sequentially by rotary conveyance drums 12. However, any suitable conveying device may be used. The primary cigarette filter units 20 are discharged or delivered from a supply pool 10 or similar delivery device, and cut into two secondary cigarette filter units 22, 24 by a cutter 16, and then delivered further downward by the rotary conveyance drums 12. Since the process of supplying and cutting the cigarette filter units is already explained hereinbefore, it will not be explained in detail here.

Figure 3:
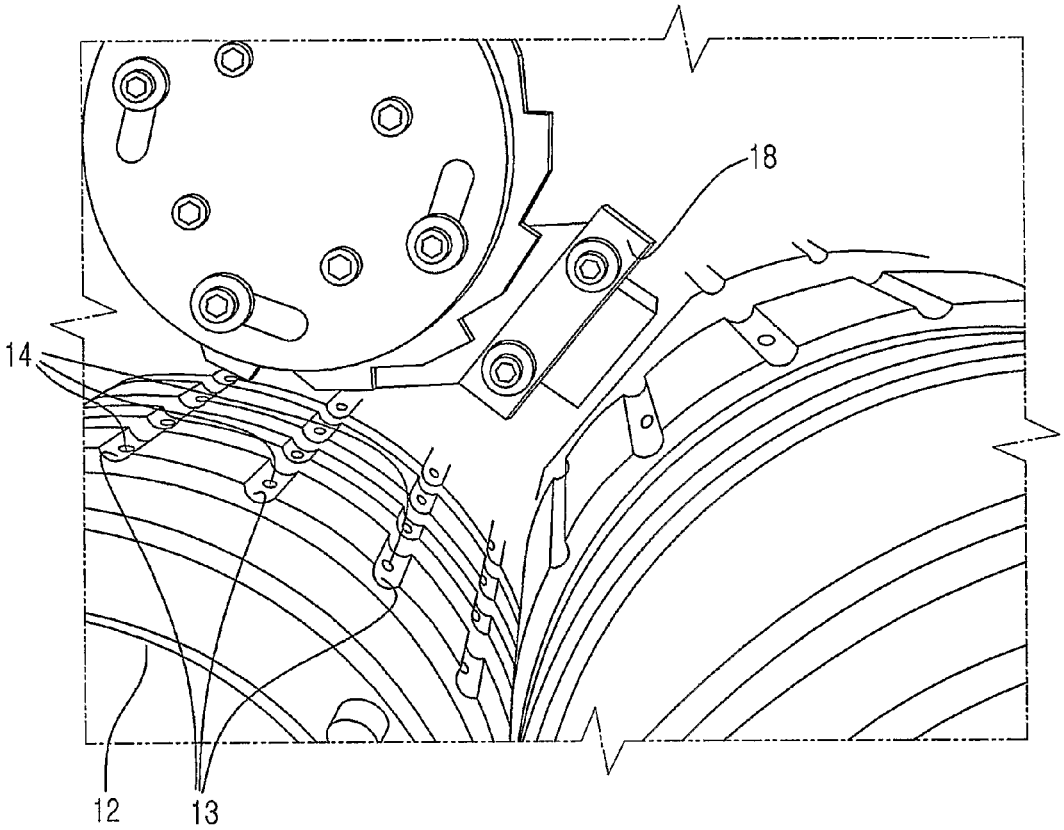
FIG. 3 shows a perspective view of the sensor and rotary conveyance drums of FIG. 1.

As shown in FIG. 3, the cigarette filter units are held in grooves 13 formed around the circumference of the rotary conveyance drums 12. The cigarette filter units are retained in the grooves 13 by vacuum suction through holes (14) formed in the grooves 13.

The cigarette filter units supplied by the plurality of rotary conveyance drums 12 are detected by a sensing unit comprising two sensors 18.

Figure 4:
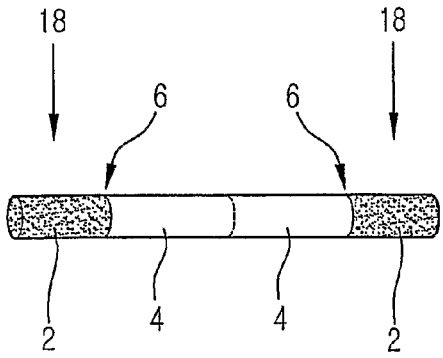
FIG. 4 shows a schematic representation of a sensing unit detecting active charcoal filters in a filter unit according to an embodiment of the invention.
Figure 5:
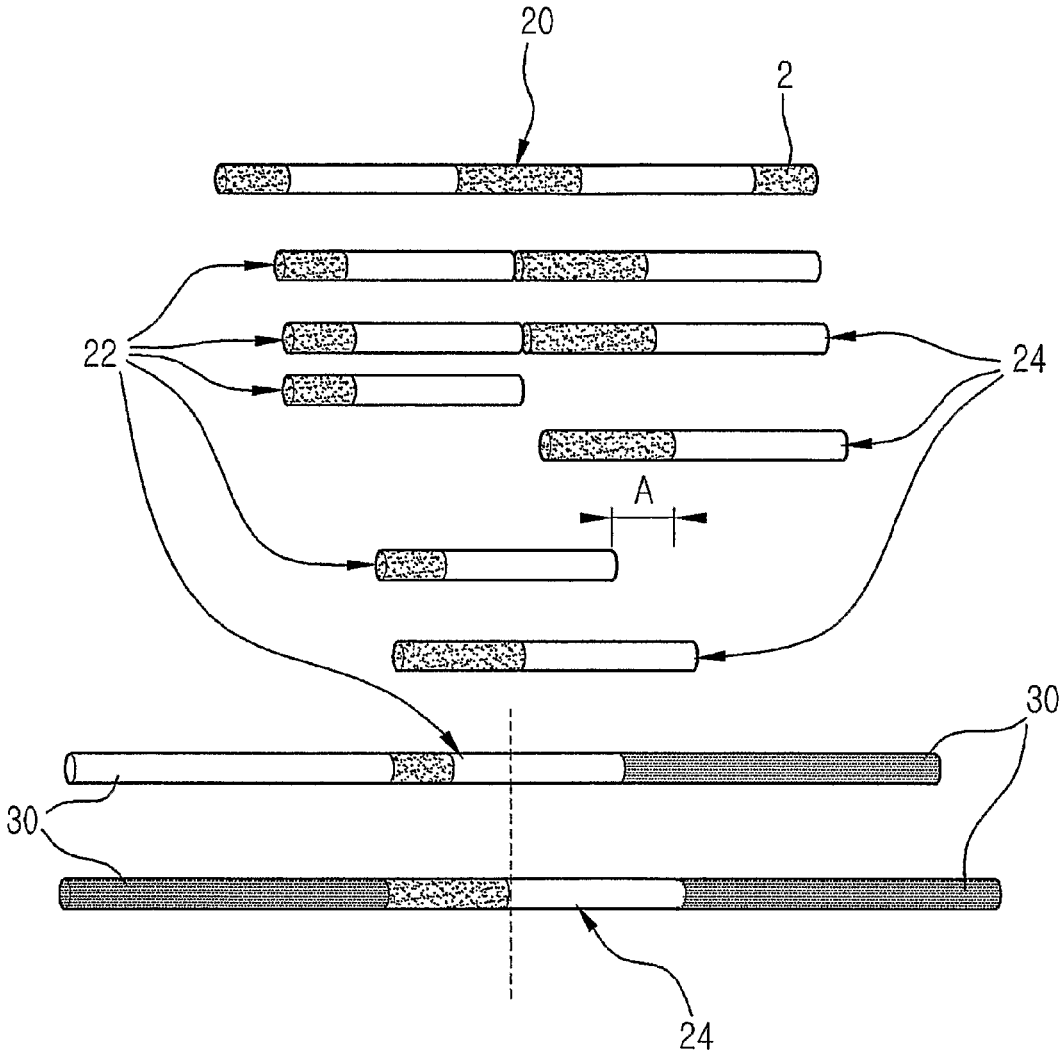
FIG. 5 shows a schematic representation of an active charcoal filter portion broken away from a filter unit during the process of FIG. 2.
Figure 6:
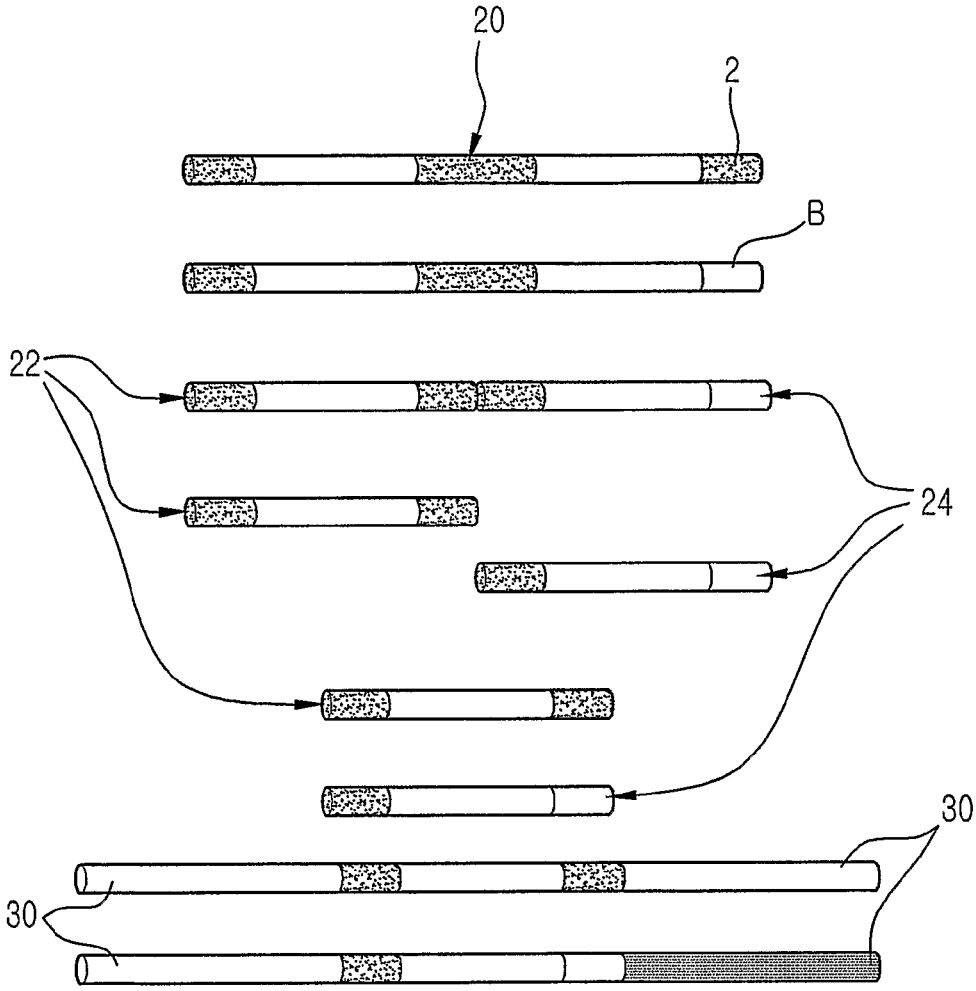
FIG. 6 shows a schematic representation of an active charcoal filter portion omitted from a filter unit during the process of FIG. 2.
Figure 7:
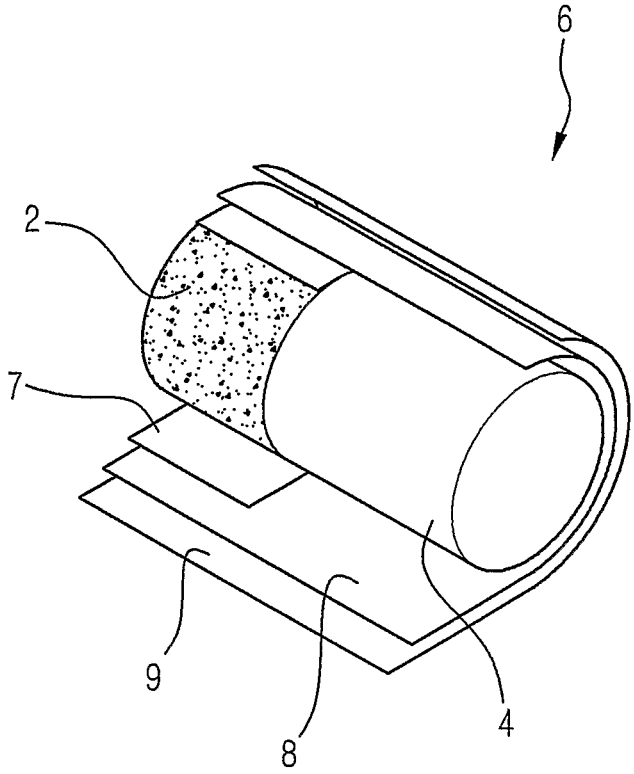
FIG. 7 shows a perspective view of a cigarette filter.

FIG. 3 is a perspective view of the sensing unit for sensing the cigarette filter units and the rotary conveyance drums 12 for delivering the filter units. The sensors 18 in the sensing unit are spaced adjacent to the rotary conveyance drums 12 delivering the cut cigarette filter units and sense the second cigarette filter units 22, 24. The sensing unit comprises two sensors 18 which are disposed above the charcoal filter portions 2 located at each end of the secondary cigarette filter units 22, 24, as shown in FIG. 4. If a charcoal filter portion 2 is broken or missing, the charcoal filter portions 2 are absent or defective at least one end of the secondary cigarette filter unit in which two dual filters are connected to each other. Therefore, when the sensors cannot detect the charcoal filter portions, the secondary cigarette filter unit is considered as being defective. Each sensor produces a signal which has a certain form if the relevant charcoal portion is both present and undamaged or non-defective. An absent or defective charcoal portion produces an abnormal signal. Therefore, the sensing unit produces two normal signals for a non-defective secondary filter unit.

The sensors 18 of the sensing unit may be optical sensors such as light and colour sensors that sense objects by light and colour. The light and colour sensors may be fibre optic ROB (red green blue) sensors, for example a product such as model No. CZ-K1P made by KEYENCE. The use of light and colour sensors allows the charcoal filter portions 2 surrounded by a plug wrap 7 of aceto paper material to be sensed. A sensor of this type can detect the existence (absence or presence) of the filter portion by the amount of received light and also it can detect contaminants, such as carbon particles, stuck to the surface of the filter. Also, the use of light and colour sensors removes the need for a variety of different sensors such as are employed in known sensing techniques. This simplifies the mounting and replacing of the sensors, and also reduces the space required for mounting the sensing unit.

Preferably, the sensing operation is performed prior to the attachment of the secondary cigarette filter units 22, 24 to the tobacco rods 30. This is because is the sensing is more difficult after the tipping paper 9 is wrapped so as to attach the tobacco rods to the filter units to form the cigarettes. Also, if a filter unit is not detected as being defective until after the cigarettes are assembled, the tobacco rods are wasted.

As explained above, a defect in the filter unit can happen when a charcoal filter portion is broken or missing, or otherwise damaged. Defects of the filter unit include the final filter having only tow filter, incorrect lengths of the charcoal filter portion or the tow filter portion, as well as dirt or breakage of the outside of the filter. When these and other defects happen, the sensors at the ends of the second cigarette filter unit cannot both detect charcoal filter portions or will produce signals different from the signals caused by normal charcoal filter portions.

If signals different from the normal signals are transmitted, the filter units may be rejected (removed from the supply of secondary filter units), by a rejection system or device and if an error repeats over a predetermined number of times, the operation of the device supplying the filter units can be stopped. In other words, the supply of filter units is modified in response to the signals from the sensors, by removal of defective units and/or stoppage of the supply system.

Generally, when a cigarette assembly system is being operated, 8,000 cigarettes per minute or about 133 cigarettes per second are produced during one cycle. That is, one cigarette is produced for about every 0.0075 second. One cycle of the system may be broken into 20 divisions, and the time for one division may be 0.000375 second. Therefore, to correspond to one division of the system, the response of the sensor can be set to 300 μsec.

The system may comprise an opto coupler such as a fibre optic coupler for combining the outputs of the two sensors to thus set the time. The two sensors (18) are connected with the opto coupler that is embodied by AND logic. The opto coupler is connected to a processing unit such as a IP (HANRUI interface card) as will be explained below. Therefore, only when both the signals from the two sensors (18) are maintained as normal signals is a high output produced by the AND logic. This is supplied to a PLC (programmable logic controller) which operates to keep the filter supplying/conveying device in normal operation. The opto coupler may be model No. ST-OV2_24DC made by PHOENIX Co. If one or both of the sensor signals is abnormal, indicating a defective filter unit, the AND logic will give a low output, and the PLC can stop the supply. Alternatively, the supply can be stopped after a predetermined number of defective filter units, as mentioned above.

The system should keep detecting the filter units produced at the rate of 8,000 cigarettes per minute during operation. However, a PLC may have a cycle time of 10 ms and thus cannot follow the production speed. Hence the cycle time is too low for the PLC to process the discharge/removal of individual defective filter units from the supply with simultaneously processing the signals and data. Therefore, the HIP is used to separately process matters with regard to the discharge, and operates the rejection device, which may for example by a discharge valve.

Figure 8:
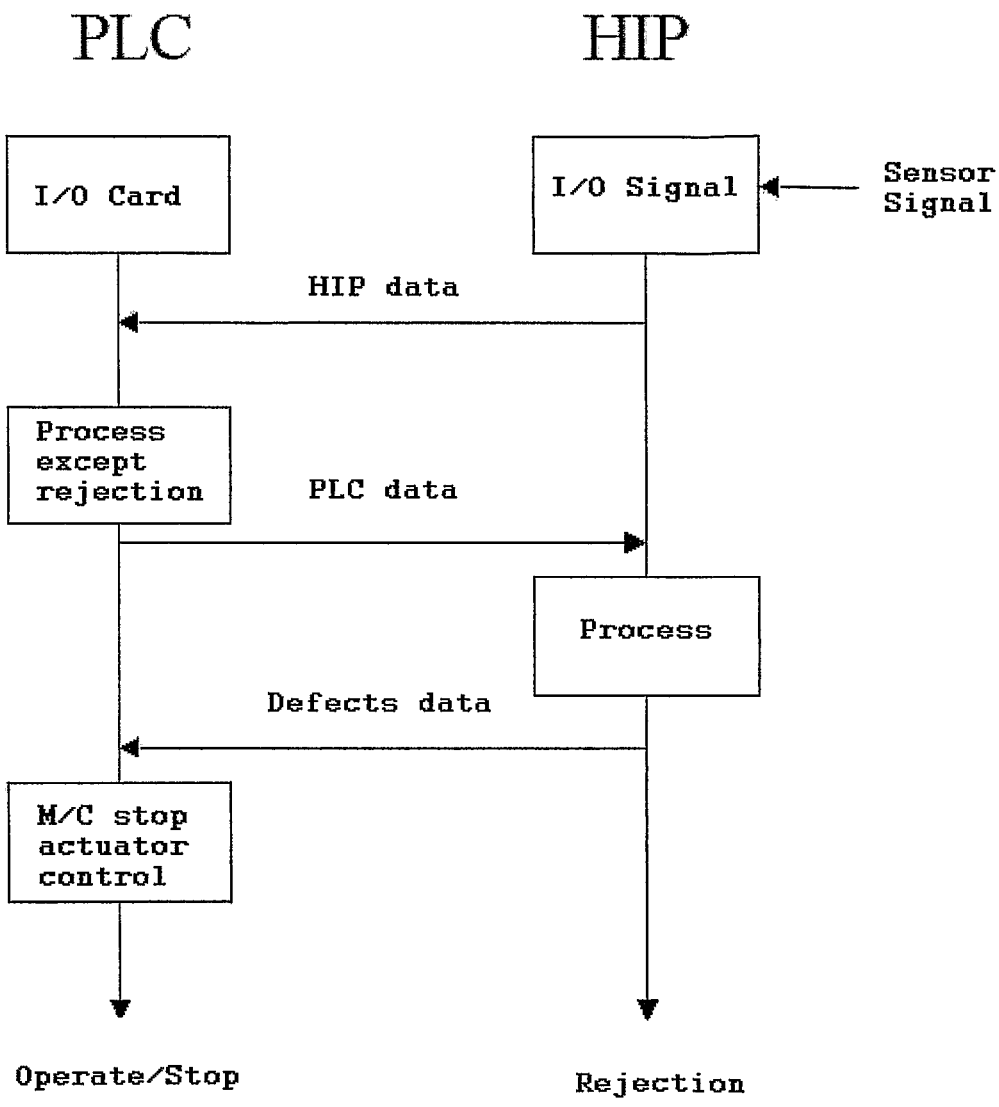
FIG. 8 shows a schematic representation of a system controller including the interrelation between a PLC and a HIP in accordance with an embodiment of the invention.

Referring to FIG. 8, the process of the PLC and the HIP can be understood. Signals received from the sensors via the opto coupler are transmitted to the HIP. Only the signals necessary to be observed are selected from the signals at the HIP and a separate process is arranged, and then only the results of data are transmitted to the PLC. The HIP processes the signals from the sensors and rejects the filter units having defects, and the other processes, such as maintaining or stopping operation of the conveying device, are performed by the PLC. The PLC and the HIP together form a controller that controls operation of the system. However, the processing of the sensor signals and the control of the system may be carried out by devices other than a PLC and a HIP, so long as the required recognition of a defective filter unit can be achieved together with some modification of the operation of the system in response to the detection of a defect, such as stopping the system after one or several defects, removing the defective filter units from the supply, and/or raising or generating an alarm or alert signal.

Accordingly, two sensors 18 are connected to the opto coupler, the signals generated by the sensors are sent to the HIP via the opto coupler, the HIP and the PLC process data about the defects of the filter units produced at a high production rate, whereby filter units having defects can be discharged and/or the operation of the device can be stopped.

In other embodiments, the sensing unit can be embodied using a number of individual sensors other than two. Two or more sensors can be positioned to sense each of the two active carbon filter portions in a secondary filter unit. Alternatively, a single sensor can be used if it has a spatial resolution that can distinguish between information received from the two ends of a secondary filter unit, so that a signal produced from a normal filter unit is distinguishable from that produced by an abnormal filter unit.

In accordance with the invention, cigarette filter units can be detected and poor products can be removed. Defects of the filter units can be detected by sensing the charcoal filter portions. Accordingly, production is improved and consumer reliance on the quality of product can be increased by removing the cigarette products having defective filters.

The embodiments which have been described herein are but some of several which utilize this invention and are set forth here by way of illustration but not of limitation. It is apparent that many other embodiments which will be readily apparent to those skilled in the art may be made without departing materially from the scope of this invention.

For example, in one embodiment there is a system for sensing a cigarette filter, comprising: a plurality of rotary conveyance drums delivering a first cigarette filter and second cigarette filters into which the first cigarette filter is divided by a cutter; two sensors disposed adjacent to the rotary conveyance drum to detect the second cigarette filters; an opto coupler connected to the two sensors and operated by AND logic; a HIP connected to the opto coupler, it controlling a device of supplying cigarette filters to reject a cigarette having defects; and a PLC connected with the HIP, it controlling the device of supplying cigarette filters, wherein the two sensors detect active charcoal filters located at both ends of the second cigarette filters, the HIP controls the device such that the cigarette having defects are rejected when signals sensed by the sensors are different from signals sensed from the normal active charcoal filter, the PLC controls the operation and stop of the device by performing the processes except the process of rejecting the cigarette having defects. The sensors may detect the active charcoal filter before the cigarette is combined with the second cigarette filters. The sensor may be a light and colour sensor.

In a further embodiment, there is a method for sensing a cigarette filter, comprising the steps: delivering a first cigarette filter and second cigarette filters into which the first cigarette filter is divided by a cutter by means of a plurality of rotary conveyance drums; detecting active charcoal filters of the second cigarette filters by means of two sensors disposed adjacent to the rotary conveyance drum; transmitting to a HIP signals of the sensors received from an opto coupler connected to the sensors and operated by AND logic; recognizing a filter as having a defect when signals of the sensors transmit to the HIP are different from signals sensed from the normal active charcoal filter, and rejecting a cigarette having the filter; and performing the processes except the process of rejecting the cigarette having defects by a PLC connected to the HIP, whereby controlling the operation and stop of the device for supplying the cigarette filter.

The invention claimed is:

1. A system for detecting defects in filters for smoking articles, comprising:

a conveying device configured to convey discrete filter units along a direction transverse to the length of the filter units, each filter unit having an active charcoal filter portion at each end and being wrapped in an inner paper;

a sensing unit positioned adjacent to the conveying device such that the discrete filter units are conveyed by the conveying device past the sensing unit along a direction transverse to the length of the filter units, the sensing unit being configured to detect two active charcoal filter portions and determine when one of the active charcoal filter portions is present and non-defective and the sensing unit is also configured to determine when one of the active charcoal filter portions is absent or defective charcoal filter portion, wherein the sensing unit comprises two sensors that are disposed adjacent to the conveying device, each sensor being positioned to detect the side of each discrete filter unit and spaced such that each sensing unit detects one of the active charcoal filter portions at each end of a filter unit, and each sensor determines a status associated with the active charcoal filter portion; and a controller configured to receive and process the determined status from the sensing unit and to modify operation of the conveying device in the event that the determined status indicate one or both active charcoal filter portions are absent or defective, wherein the determined status is processed using AND logic such that the sensing unit determines both active charcoal filter portions are present and non-defective the controller does not modify operation of the conveying device.

2. The system according to claim 1, further comprising:

a delivery device for delivering primary filter units; and a cutter arranged to cut the primary filter units into the filter units before the filter units are conveyed past the sensing unit.

3. The system according to claim 1, in which the controller is configured to stop the conveying device in the event that the determined status indicates one or both active charcoal filter portions in the filter unit are absent or defective.

4. The system according to claim 1, in which the controller is configured to stop the conveying device in the event that the determined status indicates one or both active charcoal filter portions are absent or defective in a predetermined number of filter units.

5. The system according to claim 2, further comprising:

a rejection device controlled by the controller and configured to remove the filter unit from the conveying device in the event that the determined status indicates one or both active charcoal filter portions in the filter unit are absent or defective.

6. The system according to claim 5, further comprising:

an assembly unit to which filter units with both active charcoal filter portions present and non-defective are conveyed after the filter units have been conveyed past the sensing unit, wherein the assembly unit is configured to combine the filter units with tobacco rods to produce smoking articles.

7. A method of detecting defects in filters for smoking articles, comprising:

conveying discrete filter units along a direction transverse to the length of the filter units, wherein each discrete filter unit has an active charcoal filter portion at each end and is wrapped in an inner paper, the discrete filter units are conveyed along a direction transverse to the length of the filter units past a sensing unit positioned adjacent to the conveying device to detect the two active charcoal filter portions at each end of the discrete filter unit and produce a filter integrity status that indicates each active charcoal filter is present, non-defective, absent, or defective charcoal filter portion, wherein the sensing unit comprises two sensors that are disposed adjacent to the conveying device, each sensor being positioned to detect the side of each discrete filter unit and spaced such that each sensing unit generates an active charcoal filter status for each active charcoal filter portion;

processing the active charcoal filter status from the sensing unit to determine whether the discrete filter unit has one or both active charcoal filter portions absent or defective; and modifying the conveying of the discrete filter units in the event that the active charcoal filter status indicates one or both active charcoal filter portions are absent or defective, wherein processing the active charcoal filter status comprises using AND logic such that both when active charcoal filter portions are a present and non-defective the conveying of the filter units not to be modified.

8. The method according to claim 7 further comprising:

providing the filter units for conveying by cutting primary filter units into said filter units.

9. The method according to claim 7, in which modifying the conveying comprises:

stopping the conveying in the event that the active charcoal filter status indicates one or both active charcoal filter portions in the filter unit are absent or defective.

10. The method according to claim 7, in which modifying the conveying comprises:

stopping the conveying in the event that the active charcoal filter status indicates one or both active charcoal filter portions in a predetermined number of filter units are absent or defective.

11. The method according to claim 7, in which modifying the conveying comprises:

removing a filter unit in the event that the active charcoal filter status indicates one or both active charcoal filter portions in the filter unit are absent or defective.

12. The method according to claim 7, further comprising:

combining the filter units with both active charcoal filter portions present and non-defective with tobacco rods to produce smoking articles.

* * * * *

UNITED STATES PATENT AND TRADEMARK OFFICE

CERTIFICATE OF CORRECTION

PATENT NO. : 8,515,570 B2
APPLICATION NO. : 12/065887
DATED : August 20, 2013
INVENTOR(S) : Lee It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1210 days.

Signed and Sealed this
Twenty-seventh Day of January, 2015

Michelle K. Lee

Michelle K. Lee
*Deputy Director of the United States Patent and Trademark Office*